United States Patent [19]

Burton

[11] Patent Number: 4,793,518

[45] Date of Patent: Dec. 27, 1988

[54] DISPENSER FOR BEVERAGES AND THE LIKE

[76] Inventor: John W. Burton, #4 Woodland Dr., Pittsburgh, Pa. 15228

[21] Appl. No.: 41,214

[22] Filed: Apr. 22, 1987

[51] Int. Cl.[4] ..... B65D 5/56

[52] U.S. Cl. ..... 222/129.3; 222/144.5

[58] Field of Search ..... 222/129.1, 129.3, 129.4, 222/135, 144.5, 252, 263, 266, 372, 385, 330

[56] References Cited

U.S. PATENT DOCUMENTS

| | | | |
|---|---|---|---|
| 1,202,192 | 10/1916 | Knight | 222/129.3 |
| 1,603,082 | 10/1926 | Jacobs | 222/144.5 X |
| 1,944,809 | 1/1934 | Rogers | 222/129.3 |
| 2,160,983 | 6/1939 | Painter | 222/129.3 |
| 2,515,570 | 7/1950 | Rubinfield | 222/135 |
| 2,982,446 | 5/1961 | Liolos et al. | 222/145 |
| 3,141,573 | 7/1964 | Patch | 222/129.1 |
| 3,206,069 | 9/1965 | Jacobs et al. | 222/1 |
| 3,225,965 | 12/1965 | Jacobs et al. | 222/129.1 |
| 3,302,831 | 2/1967 | Matheny | 222/144.5 X |
| 3,349,967 | 10/1967 | Schneller | 222/130 |
| 3,664,550 | 5/1972 | Carothers et al. | 222/129.2 |
| 3,883,043 | 5/1975 | Lane | 222/82 |
| 4,173,296 | 11/1979 | Marshall | 222/1 |
| 4,319,698 | 3/1982 | Tomiyama et al. | 222/146 |
| 4,440,318 | 4/1984 | Berger | 222/129.1 |
| 4,493,441 | 1/1985 | Sedam et al. | 222/129.1 |

FOREIGN PATENT DOCUMENTS 2000485 1/1979 United Kingdom .

*Primary Examiner*—Michael S. Huppert
*Attorney, Agent, or Firm*—Buchanan Ingersoll

[57] ABSTRACT

A dispenser for dispensing flavored beverages and other liquids is disclosed which is comprised of a housing having a base and a front plate with a first slot and a second slot extending at an angle from the first slot. Within the housing on its base are provided at least one container with a plunger-type pump. A tube extends from the pump to an opening in the front plate. Also provided is a nozzle at the opening of the front plate which is connected to a liquid supply source. A valve is attached to the nozzle having an outwardly extending stem which is engaged by a bar pivotally attached to the housing. This bar is substantially parallel to the first slot. Finally, a lever is attached to the housing so that it may extend and move through the first and second slot. The lever is sized and positioned so as to be able to engage and activate a plunger-type pump and the bar when moved downwardly through a second slot. A slit-type valve is preferably attached to the end of each tube which extends from a plunger-type pump.

20 Claims, 3 Drawing Sheets

DISPENSER FOR BEVERAGES AND THE LIKE

FIELD OF INVENTION

The present invention relates to dispensers for beverages and other liquids.

DESCRIPTION OF THE PRIOR ART

A number of dispensers have been developed for dispensing liquids of the type which include a carrier and optional pigments or flavors. These machines are particularly useful for dispensing carbonated beverages and mixing various colors of paints. Generally, there is provided a number of reservoirs having colors or flavors which are dispensed into the container along with a basic carrier typically white paint or club soda.

One typical carbonated beverage dispenser consists essentially of a discharge nozzle mounted on a counter or stand connected through piping to a replaceable storage container filled with pre-mixed carbonated beverage. A pressurized cylinder of carbon dioxide is connected to the container. This cylinder is not used for carbonating, but is merely a source of pressure for discharging the beverage through the container. If several flavors or varieties of beverage are desired, separate storage containers and nozzles are used for each selection.

Some soda fountains and similar establishments have their own carbonating equipment installed on the premises. They produce carbonated water to which flavors are added. Typically, the beverage is mixed at the point of sale either in the glass or by means of a mixing nozzle which injects syrup into the water as it is dispensed into a glass. These systems have several containers of flavor Flavors are dispensed either by gravity flow or by pressurizing the flavor containers.

Most of the prior art dispensers have been developed for commercial use. They are too large or too expensive for use in the home. Consequently, there is a need for an inexpensive dispenser for home use which can be used to mix beverages and other liquids.

SUMMARY OF THE INVENTION

The present invention is a dispenser which is particularly useful for dispensing flavored beverages. I prefer to provide a plurality of containers of flavors having a plunger-type valve of the type normally found on hand lotion and soft soap bottles. These containers are positioned in a housing. In the housing there is a lever which is pivotable in both the vertical and horizontal directions. I provide a horizontal bar which is positioned to extend in front of the plunger-type pumps. This horizontal bar is connected to a push-type valve which dispenses the liquid base material, preferably from a pressurized container. Flavor syrup is dispensed by positioning the moveable lever over the pump of a flavor dispenser and pressing down. This causes the plunger of the pump to move downward and release flavor syrup. If one continues to press the lever down it will strike the bar which controls the delivery of liquid. Continued downward pressure on the lever will push the bar down which opens the valve and dispenses the base liquid.

I prefer to provide a tube extending from each flavor dispenser valve to a position beneath which a cup can be placed. At the distal end of each tube I provide an inexpensive slit-type eye dropper valve. If carbonated beverages are to be served the plug valve is attached to a diffuser. One places a cup or other container below the diffuser and distal ends of the flavor tubes. Then he positions the moveable lever over a flavor pump and pushes down to dispense a selected flavor into the cup. If more flavor is desired, he lifts the lever and presses it down again. If he continues to press the lever downward, so it moves the horizontal bar, he will dispense the liquid material Thus, one controls the dispensing of flavor and liquid with a single lever.

I prefer to provide a front plate on the housing which has horizontal slot from which a series of vertical slots are extended. The lever extends through the horizontal slot and can be positioned over any vertical slot. Each slot corresponds to a flavor and one liquid only selection. Thus, when the lever is pushed through a vertical slot it will now be over a flavor pump and the selected flavor syrup will be dispensed. Appropriate labels are placed on the front plate to identify the flavor which corresponds to each slot.

My dispenser can be made primarily of lightweight molded plastic. It is compact enough to fit on a counter and easy to use. Other objects and advantages of the invention will become apparent as the following description of the present preferred embodiments proceeds.

BRIEF DESCRIPTION OF THE PREFERRED EMBODIMENTS

Figure 1:
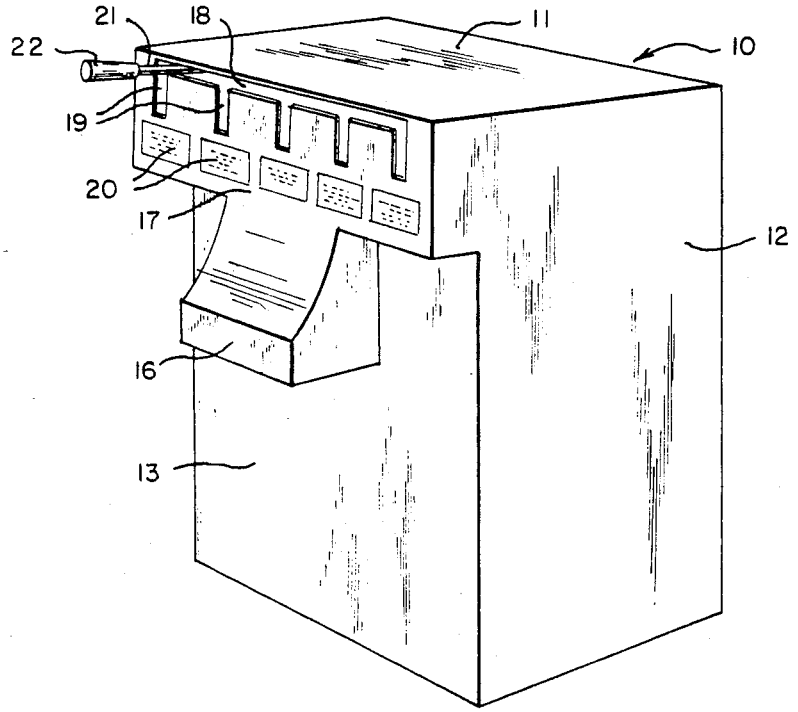
FIG. 1 is a perspective view of my dispenser.
Figure 2:
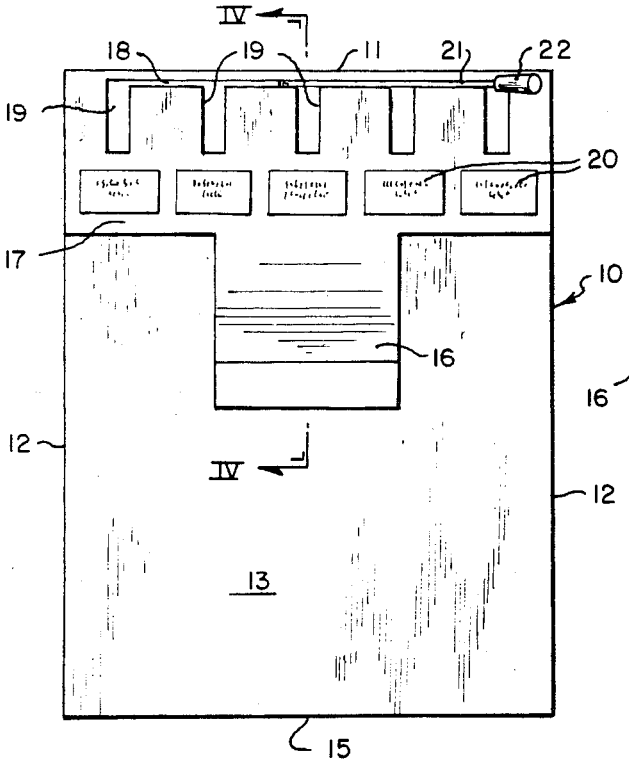
FIG. 2 is a front view of the embodiment of FIG. 1.
Figure 3:
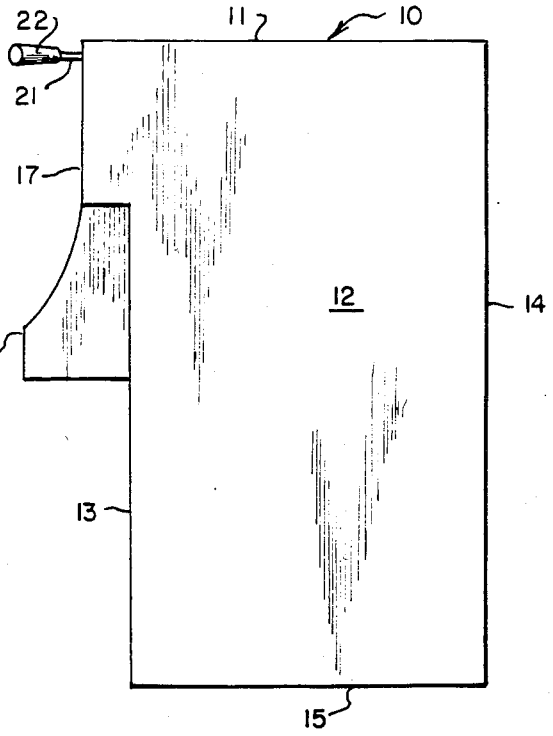
FIG. 3 is a side elevation view of my dispenser as viewed from the right side of FIG. 2.

Referring to FIGS. 1, 2 and 3, I provide a housing 10 in which there are contained a plurality of flavor or pigment containers. Housing 10 is generally rectangular having a flat top 11, opposite sides 12, front 13, optional back 14 and bottom 15. A nozzle hood 16 and front plate 17 are attached to the front. A horizontal slot 18 and a plurality of vertical slots 19 are provided in the front plate 17. I prefer to provide labels 20 on the front plate 17 to identify each vertical slot 19. A lever 21 with a handle 22 extends through slot 18. This lever 21 is attached to the housing 10 by a universal joint 23 (see FIG. 4). This permits the lever to be moved horizontally through slot 18 and vertically through any slot 19.

Figure 4:
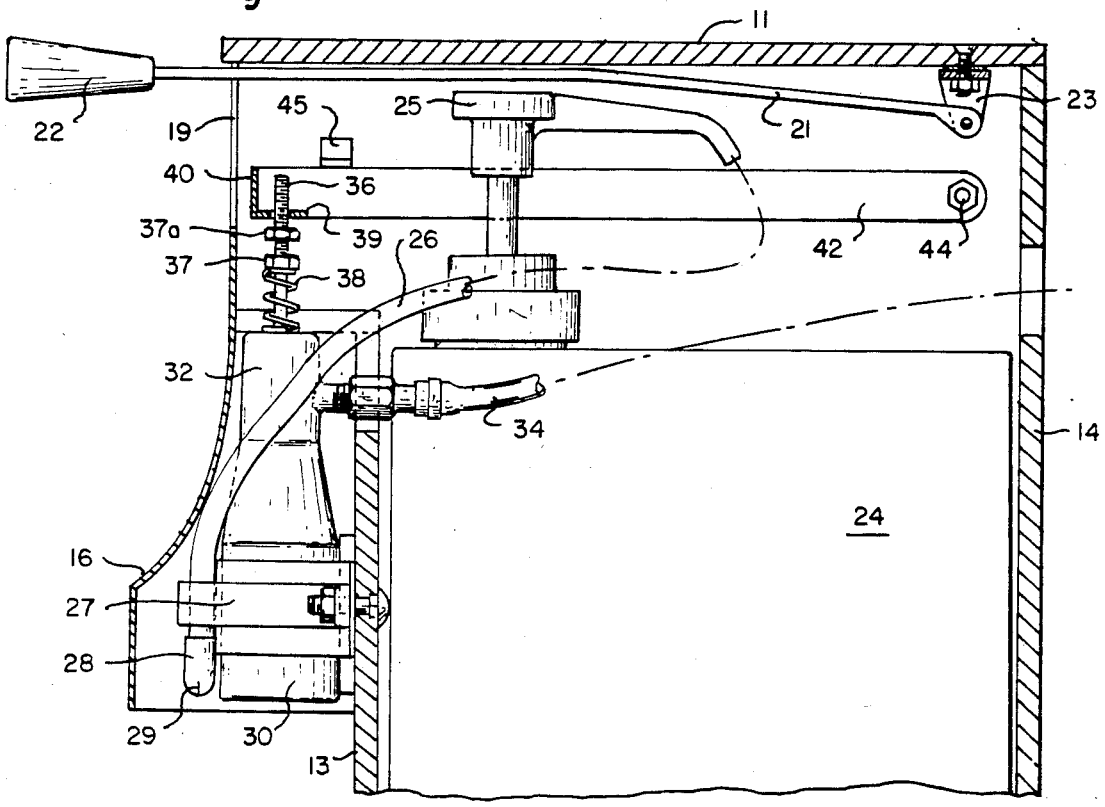
FIG. 4 is a sectional view of the top half of my dispenser taken along, the line IV—IV of FIG. 2.
Figure 5:
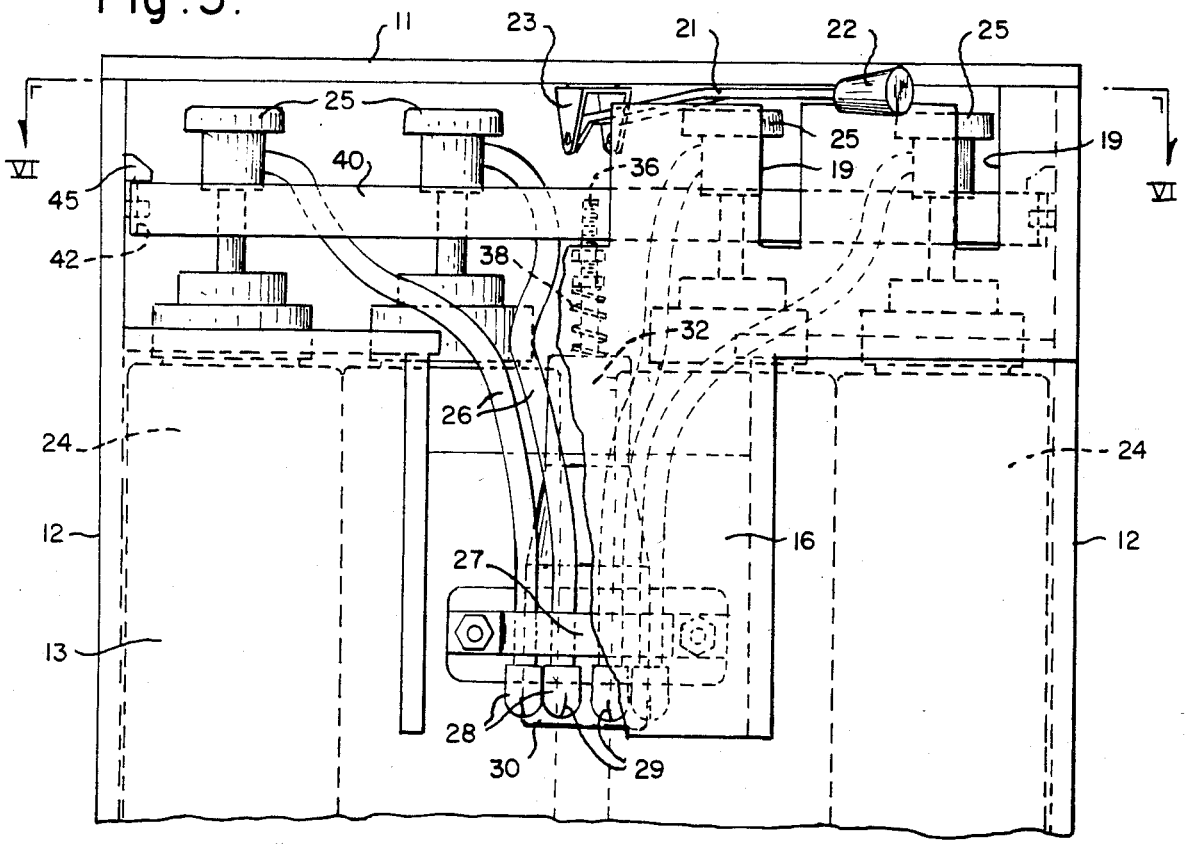
FIG. 5 is a front view of the top half of my dispenser with the nozzle hood and portion of the front plate removed.
Figure 6:
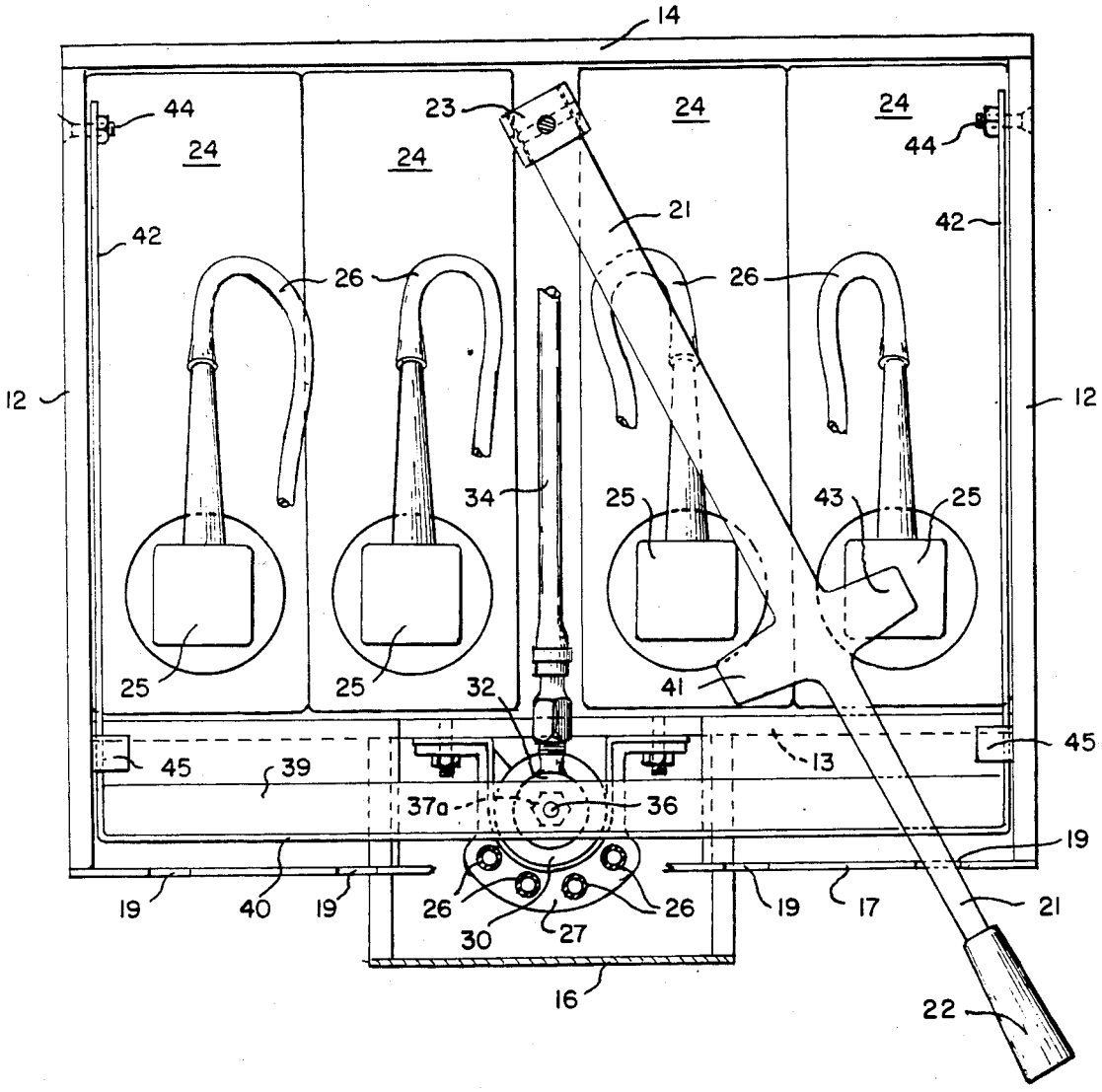
FIG. 6 is a cross-sectional view taken along line VI—VI of FIG. 5.

As shown in FIGS. 4 thru 6, I provide a plurality of flavor containers 24 which are placed in the housing on bottom 15. Preferably, the containers are relatively narrow to allow several containers to fit within the housing 10. These containers 24 can be replaced simply by removing the back 14 of the housing 10 and sliding the container out. On each container there is a plunger-type pump 25. By pushing the plunger 25 down one pumps pigment or flavor from container 24. As shown in FIG. 5, I prefer to use the same plunger-type pump 25 for all containers 24. I also prefer to make containers 24 the same size. Then the containers 24 are interchangeable and every plunger 25 will fit every container 24. I further prefer to make both the containers 24 and plungers 25 of plastic. A tube 26 extends from each plunger-type pump 25 to a remote position beneath which one may place a cup or other container. At the distal end of tube 26 there is an eye dropper type valve 28 with a slit 29. Tubes 26 are arranged in a spacer 27 about a diffuser or other nozzle 30 which is connected to a plug valve 32 that in turn is connected to supply tube 34. Tube 34 leads to a remote source of preferably pressurized liquid such as club soda. The liquid source may also be positioned to allow gravity feed of liquid. Plug valve 32 has a stem 36 which extends upwardly through bar 40. A spring 38 is provided on the stem to keep plug valve 32 closed while under pressure from liquid in supply tube 34 and to maintain bar 40 in a predetermined rest position. In this rest position valve 32 is closed. Stem 36 is threaded at its upper end and extends through a hole in tab 39 on bar 40. Nut 37 is provided on stem 36 to adjust the tension on spring 38 and plug valve 32. A second nut **37*a* determines the point where bar 40 engages valve stem 36. Control bar 40 has arms 42 which extend from either end and are pivotally attached to sides 12 by connectors 44. Because it is pivotably attached through arms 42, bar 40 can move up and down. Normally spring 38 will keep bar 40 in its uppermost position as shown in the drawings. Screws or bosses 45 may be provided in both sides 12 of the housing 10 to block upward movement of bar 40 above a predetermined position. In this position plug valve 32 is closed and no liquid flows through nozzle 30. When lever 21 is moved through a vertical slot 19 it will engage bar 40 and press it down. Downward movement of bar 40 opens valve 32 and allows liquid to flow through nozzle 30. When lever 21 is at its lowermost position in slot 19, valve 32 will be fully open. As can be seen in FIG. 5 I prefer to allow lever 21 to travel about half way through slot 19 before it engages bar 40. As will be seen, this allows me to pump flavors from a container 24 without dispensing liquid through nozzle 30. Further downward movement of lever 21** releases and mixes both flavor syrup and liquid soda water.

As can be clearly seen in FIG. 6, lever 21 is pivotally attached by joint 23 to housing 10 which allows it to be positioned over any of the flavor pumps 25 or in a neutral position immediately above valve 32. I have found it desirable to provide wings 41 and 43 on the lever for easy engagement of the tops of the flavor pumps 25. As can be seen from FIG. 6, when the lever 21 is in a far right position, wing 43 will be over the far right flavor pump. Conversely, wing 41 will be over the far left flavor pump when lever 21 is in the far left slot. The centerline of lever 21 will be over a flavor pump when it is in the left center slot or the right center slot. Only liquid, such as club soda, can be released when lever 21 moves downward and depresses bar 40. When lever 21 is in the center slot no flavor pump can be activated. When lever 21 or its wings 41 and 43 is over flavor pump 25 one can dispense flavor by pressing the lever down until it reaches bar 40. If one continues to press lever 21 downwardly it will engage bar 40. As bar 40 moves downward it moves valve stem 36 which opens plug valve 32 allowing liquid to be dispensed through the diffuser 30. If one stops the downward motion of lever 21 when it reaches bar 40 and returns lever 21 to its original, uppermost position one can dispense more flavor without any liquid having been dispensed. When lever 21 is in the center slot only liquid can be dispensed. Thus, the user can determine both the variety and amount of flavor dispensed. My dispenser also enables the user to select only flavor or only liquid such as club soda.

In the drawings I have shown four flavor containers 24 and one neutral position. It should be readily apparent to those skilled in the art that a greater or lesser number of containers may be used. However, I have found that four containers each having a capacity of approximately 64 ounces provides an adequate selection for most people. Since the containers are easily removable one may keep additional flavor containers on hand and interchange them as desired.

I prefer to make nearly all of the components of my dispenser from plastic. Then my dispenser is inexpensive, lightweight and easily placed on a counter or bar.

I have described and illustrated activation of the pumps and horizontal bar by movement of the lever toward the base of the container which I call downward movement. It should be apparent to those skilled in the art that pumps 25, bar 40 and lever 21 could be sized and positioned so that movement of the lever upward toward the top of the container activates the pumps and liquid dispenser valve. Also one could easily rotate my dispenser ninety degrees without departing from my invention even though the horizontal slot is now vertical and the vertical slots are horizontal.

Even though I have described this dispenser in the context of carbonated beverages, it should be readily apparent that one could use a variety of materials with this dispenser. For example, one might choose to fill containers 12 with various types of liquors and dispense club soda. One might also choose to fill containers 24 with pigments and dispense white paint. I have shown a diffuser valve in this dispenser, but it should be readily apparent that the diffuser is not necessary particularly where non-carbonated liquids are being dispensed.

Although I have shown and described various embodiments of the present invention, it should be distinctly understood that the invention is not limited thereto, but may be variously embodied within the scope of the following claims.

I claim:

1. A dispenser comprised of a. a housing having a base and a front wherein an opening is provided in the front through which liquids can be dispensed and a first slot and at least one second slot extending at an angle from the first slot are provided in the front;

b. at least one container positioned within the housing on its base;

c. a plunger type pump attached to the container;

d. a tube extending from the pump to the opening at the front plate;

e. a nozzle attached to the housing in a manner to allow liquid to flow through the nozzle and out of the opening in the front plate;

f. a valve attached to the nozzle having an outwardly extending stem movement of which opens and closes the valve and having an inlet which may be connected to a liquid supply;

g. a bar pivotally attached to the housing, said bar extending substantially parallel to the first slot and attached to the valve stem so that movement of the bar will move the valve stem to open the valve; and h. a lever attached to the housing in a manner so that it may extend and move through the first and second slots an sized and positioned so that it will engage and activate said plunger type pump and the bar when moved downwardly through said second slot.

2. The dispenser of claim 1 wherein the front has a third vertical slot extending from the first slot so that the lever will engage the bar and not engage a pump when the lever travels through the third slot.

3. The dispenser of claim 1 wherein the first slot, at least one second slot, plunger type pump, bar pivotably attached to the housing, and lever are sized and positioned so that the lever will activate only the pump when the lever travels through a portion of the second slot and move the bar when it continues through the second slot.

4. The dispenser of claim 1 also comprising a slit type valve attached to the tube extending from the pump.

5. The dispenser of claim 1 also comprising a spring positioned around and biasing the valve stem.

6. The dispenser of claim 5 wherein the valve stem is threaded and also comprising a nut on the valve stem for adjusting the tension of the spring.

7. The dispenser of claim 6 also comprising a second nut on the valve stem for determining the point at which the bar engages the valve stem.

8. The dispenser of claim 1 also comprising a removable back attached to the base of the housing.

9. The dispenser of claim 1 wherein there are a plurality of containers, the front has a plurality of vertical slots extending from the first slot and the lever is a bar having on opposite sides a wing extending from each side, each wing being sized and positioned to engage at least one outermost plunger type pump when the lever is in a outermost vertical slot.

10. The dispenser of claim 1 also comprising at least one boss attached to the housing and positioned so as to prevent the bar from moving past the boss.

11. The dispenser of claim wherein the containers have screw top openings into which the plunger type pumps are fitted.

12. The dispenser of claim 11 wherein each plunger type pump will fit all containers.

13. The dispenser of claim 1 wherein the container and pumps are plastic.

14. The dispenser of claim 1 having a plurality of containers, each container having a narrow width to permit several containers to be placed in the housing.

15. The dispenser of claim 1 also comprising a liquid supply source connected to the valve.

16. The dispenser of claim 15 also comprising a pressurized liquid within the liquid supply source.

17. The dispenser of claim 15 wherein the liquid supply source is positioned to allow gravity to cause liquid to flow from the supply source to the valve.

18. The dispenser of claim 1 also comprising a valve stem wherein said valve stem is threaded and extends from the valve through the bar, a first nut on the valve stem adjacent to the bar, a spring on the valve stem and a second nut on the valve stem for tensioning the spring.

19. The dispenser of claim 1 wherein the nozzle is a diffuser nozzle.

20. The dispenser of claim 19 wherein the nozzle and valve are formed integrally as one unit having the diffuser positioned so that liquid flows through the valve and then through the diffuser.

* * * * *

UNITED STATES PATENT AND TRADEMARK OFFICE

CERTIFICATE OF CORRECTION

PATENT NO. : 4,793,518

DATED : December 27, 1988

INVENTOR(S) : JOHN W. BURTON

It is certified that error appears in the above-identified patent and that said Letters Patent is hereby corrected as shown below:

Column 2, line 8, after "material" insert --.--.

Column 6, line 4, Claim 11, after "claim" insert --1--.

Column 6, line 23, Claim 18, change the third occurrence of "the" to --said--.

Signed and Sealed this

Thirtieth Day of May, 1989

*Attest:*

*Attesting Officer*

DONALD J. QUIGG

*Commissioner of Patents and Trademarks*